US007059130B2

(12) United States Patent
Kawamura

(10) Patent No.: US 7,059,130 B2
(45) Date of Patent: Jun. 13, 2006

(54) HEAT EXCHANGER APPLICABLE TO FUEL-REFORMING SYSTEM AND TURBO-GENERATOR SYSTEM

(75) Inventor: Hideo Kawamura, 13-5, Okada 8-chome, Samukawa-machi, Kouza-gun, Kanagawa-ken (JP) 253-0105

(73) Assignees: Ship & Ocean Foundation, Tokyo (JP); Hideo Kawamura, Kanagawa-Ken (JP)

( * ) Notice: Subject to any disclaimer, the term of this patent is extended or adjusted under 35 U.S.C. 154(b) by 241 days.

(21) Appl. No.: 10/703,520

(22) Filed: Nov. 10, 2003

(65) Prior Publication Data

US 2004/0103660 A1 Jun. 3, 2004

(30) Foreign Application Priority Data

Feb. 13, 2002 (JP) ..... 2002-035728
Nov. 8, 2002 (JP) ..... 2002-325045
Nov. 8, 2002 (JP) ..... 2002-325052

(51) Int. Cl.
*F01K 23/10* (2006.01)
*F28D 7/02* (2006.01)
*B22F 3/10* (2006.01)
*H01F 3/02* (2006.01)
*H01M 8/18* (2006.01)

(52) U.S. Cl. ..... 60/618; 165/165 X; 165/907 X; 429/19; 428/550; 428/566

(58) Field of Classification Search ..... 60/618; 165/907 X, 905, 181, 165 X, 164, 166, 133, 165/135; 429/13, 24, 34; 428/566, 550; 423/299; 422/202; F02F 1/12, 13/18; F01K 23/10
See application file for complete search history.

(56) References Cited

U.S. PATENT DOCUMENTS 3,587,730 A * 6/1971 Milton ..... 165/181
3,776,303 A * 12/1973 Anderson et al. ..... 165/165
4,064,914 A * 12/1977 Grant ..... 165/907
4,291,758 A * 9/1981 Fujii et al. ..... 165/907
4,359,086 A * 11/1982 Sanborn et al. ..... 165/907
4,795,618 A * 1/1989 Laumen ..... 422/202
4,917,960 A * 4/1990 Hornberger et al. ..... 428/550
5,014,773 A * 5/1991 Beduz et al. ..... 165/115
5,204,302 A * 4/1993 Gorynin et al. ..... 502/2
5,441,716 A * 8/1995 Rockenfeller ..... 423/299
5,943,859 A * 8/1999 Kawamura ..... 60/320

(Continued)

FOREIGN PATENT DOCUMENTS

FR 2026088 A * 9/1970

(Continued)

*Primary Examiner*—Thai-Ba Trieu
(74) *Attorney, Agent, or Firm*—Browdy and Neimark, PLLC

(57) ABSTRACT

A heat exchanger is applied well to a turbo-generator system and a fuel-reforming system. The heat exchanger has porous metals disposed in a hotter area and a colder area, one to each area, and a wall separating the two areas from one another. The porous metals are merged integrally with the wall through junction layers to raise the efficiency of the heat exchanger. The porous metals in the hotter and colder areas are merged together with the opposite surfaces of the wall through junction layers buried into the porous metals. The junction layers are made of pasty joining material kneaded with a powdery metal. The junction layers over the porous metals are brought into close contact with the opposite surfaces of the wall and subjected to sintering to get the porous metals merging together with the wall.

24 Claims, 8 Drawing Sheets

U.S. PATENT DOCUMENTS

| | | | | |
|---|---|---|---|---|
| 6,079,373 | A * | 6/2000 | Kawamura | 123/3 |
| 6,082,444 | A * | 7/2000 | Harada et al. | 165/133 |
| 6,089,020 | A * | 7/2000 | Kawamura | 60/618 |
| 6,119,457 | A * | 9/2000 | Kawamura | 60/618 |
| 6,232,005 | B1 * | 5/2001 | Pettit | 429/19 |
| 6,773,825 | B1 * | 8/2004 | Pickrell et al. | 428/566 |

FOREIGN PATENT DOCUMENTS

| | | | |
|---|---|---|---|
| FR | 2738625 | A3 * | 3/1997 |
| JP | 55035462 | A * | 3/1980 |
| JP | 58055693 | A * | 4/1983 |
| JP | 591253966 | A * | 7/1984 |
| JP | 60162195 | A * | 8/1985 |
| JP | 61083895 | A * | 4/1986 |
| JP | 6601-1999 | | 1/1999 |
| JP | 6602-1999 | | 1/1999 |
| JP | 13547-1999 | | 1/1999 |
| JP | 51582-1999 | | 2/1999 |
| JP | 93777-1999 | | 4/1999 |
| JP | 2003-239809 | | 8/2003 |
| JP | 2004244268 | A * | 9/2004 |

* cited by examiner

HEAT EXCHANGER APPLICABLE TO FUEL-REFORMING SYSTEM AND TURBO-GENERATOR SYSTEM

BACKGROUND OF THE INVENTION

1. Field of the Invention

The present invention relates to a heat exchanger having a porous metal, in which thermal energy of exhaust gases is available for the thermal decomposition of natural gas to produce reformed fuel, the generation of steam from water, the condensing of a vapor to a liquid, the warming of an oily substance, and so on.

2. Description of the Prior Art

Among conventional systems for reclaiming heat energy from exhaust gases emitted out of any heat resource including engines, combustion chambers and so on are commonly any systems where an exhaust gas turbine is used to convert the exhaust heat to either kinetic energy or electric energy. With the prior turbo-compound systems in which the exhaust turbine is connected to the exhaust pipe from the engine, nevertheless, any excessive increase in ingress pressure of the exhaust gas turbine would cause heavy loads on the exhaust phase of the engine, resulting in adversely giving rise to any loss in power. To cope with this, it has been preferred that the exhaust gas turbine is less in ingress pressure while the energy conversion is made using steam power.

Some sort of a heat exchanger disclosed in, for example Japanese Patent Laid-Open No. 6601/1999 is known, in which a porous ceramics member is installed in a gas passage while first-stage and second-stage heat exchangers are provided in the course of an exhaust line out of a gas engine to boost the steam in temperature. The first-stage heat exchanger is constituted with a steam passage installed in a first casing to allow the steam to flow through there, and an exhaust gas passage arranged in the steam passage to get the exhaust gases running through there. The second-stage heat exchanger includes a water-steam line allowed to hold water therein, which is installed in a second casing lying behind the first casing, and an exhaust gas line surrounding around the water-steam line to allow the exhaust gases to flow through there.

A natural gas-reforming system disclosed in, for example Japanese Patent Laid-Open No. 93777/1999 is also known, in which the principal constituent: $CH_4$ in natural gas is pyrolyzed to the reformed fuel of CO and $H_2$ to improve the gas engine in thermal efficiency, and further the $CO_2$ contained in the exhaust gases is used for the pyrolysis, thus rendering the $CO_2$ content in the exhaust gases reduced. With the fuel-reforming system recited earlier, an exhaust gas passage is defined inside an exhaust gas tube while a gaseous fuel casing is disposed around the exhaust gas tube to allow the gaseous fuel to flow through there. The gaseous fuel casing is filled with porous ceramic substance coated with a catalyst helping convert the $CH_4$ in natural gas into CO and $H_2$. In addition, the gaseous fuel casing is shielded around there with a thermal insulation.

Another sort of a gas engine with fuel-reforming system disclosed in, for example Japanese Patent Laid-Open No. 13547/1999 is known, in which the principal constituent of $CH_4$ in natural gas is pyrolyzed to CO and $H_2$ to improve the gaseous fuel in calorific value, while the $CO_2$ contained in the exhaust gases is used for the pyrolysis, thereby the $CO_2$ content in the exhaust gases getting reduced and further the formation of NOx is curbed. With the gas engine constructed as stated earlier, a mixture of $CH_4$ with $CO_2$ is fed into a catalytic converter installed in the exhaust pipe, where the gaseous mixture is heated and pyrolyzed with the exhaust gases to convert into reformed fuel. The $CO_2$ separated out from the exhaust gases though a separator membrane is forced into the catalytic converter. Heat energy remaining in the exhaust gases is reclaimed at a turbo-charger and also discharged at the first and second heat exchangers to produce high-temperature steam that is in turn used to drive a steam turbine, which would result in reclaiming the heat energy as electric energy.

A steam engine working on Rankine cycle disclosed in, for example Japanese Patent Laid-Open No. 51582/1999 is also known which is comprised of a steam generator to convert the liquid to vapor, a steam turbine driven with the vapor produced in the steam generator, a condenser to reduce exhaust steam from the steam turbine to a liquid, and a pump to return the liquid discharged out of the condenser back to the steam generator. The condenser is composed of an inside cylinder providing a fluid passage to allow the steam leaving the steam turbine to flow through there, the inside cylinder having a rotor of permanent magnet, a first porous member installed in the fluid passage, a second porous member wound around the inside cylinder in a spiral way to form successive fins, and an outside cylinder surrounding around the successive fins to provide an air passage in which any one fin and a circular space separating any two successive fins alternate lengthwise within the outer cylinder, the outer cylinder having a stator in opposition to the rotor on the inside cylinder to bear the inside cylinder for rotation thereon.

A gas engine disclosed in, for example Japanese Patent Laid-Open No. 6602/1999 is also known, in which an energy recovery means with heat exchanger is disposed behind a turbocharger installed in an exhaust pipe. High-temperature steam produced in the heat exchanger passes through a steam turbine to produce electric power by the action of a generator coupled with the steam turbine. The gas engine employs fuel of natural gas and is applicable well to, for example a cogeneration system. The gas engine includes a fuel tank to hold a natural gas containing a principal constituent of $CH_4$, a fuel pump to forcibly feed the gaseous fuel into an auxiliary chamber connected to a main combustion chamber, a first heat exchanger unit installed behind the turbocharger in the exhaust pipe, a steam turbine driven by the steam produced in the first heat exchanger unit, and a second heat exchanger unit disposed behind the first heat exchanger unit to convert a low-temperature vapor and water leaving the steam turbine into a high-temperature vapor that is fed back to the first heat exchanger unit. The generator, when driven by-the steam turbine, produces electric power in proportion to turning force exerted by the turbine.

Meanwhile, a heat exchanger made of ceramics of porous texture has been developed in late years. Nevertheless, the ceramic products, because of vulnerable to impact stress and therefore less in fracture toughness, are very unfit to employ them for the heat exchanger that is commonly sophisticated in configuration. To cope with this, the advent of a heat exchanger of porous metal has been expected until now. Production of the heat exchanger with porous metal, however, has been tried with little success so far because porous metal is very tough to join it with solid metal sheet.

Moreover, the heat exchanger should be high in efficiency for the reclaiming of heat energy from the exhaust gases. With the engines of turbo-compound type employing the fuel of natural gas, the combustion chamber has to be made in heat insulation to exploit the most of heat energy from the exhaust gases, converting the most of energy derived from the fuel into power. Effectiveness in the heat exchanger is very crucial for the heat transfer from one fluid to another. That is, the higher the effectiveness in the heat exchanger is, the better it is for available rate of heat energy and therefore for the overall thermal efficiency. The operating fluids have considerable affect on the effectiveness of the heat exchanger in both their heat conductivity and heat transfer rate, and also less thermal resistance is preferred for smooth mobility of heat.

In recent years, many advanced researches in foamed heat-resisting metals higher in heat conductivity have focused attention on the production of porous metallic members that are preferable for diverse uses including filters and so on. The porous metallic product has a complex geometrical construction in which metals get entangled and intersected with one another in three-dimensional structure, and therefore has the outside surface area per unit volume, which is up to about six times greater than the conventional fins and further made continuous over the product block. This feature is fit well for heat transfer between the fluids that are different in temperature from one another.

Thus, the present inventor has led to the concept that porous metallic members are joined together with opposite sides of metallic sheet, one to each side, which is a partition wall to separate two fluids at different temperatures from one another to provide a heat-extracting area or hotter area and a heat-emitting area or colder area in opposition to each other across the partition wall. When the hot fluid including a hot gas and so on passes over the heat-extracting area or hotter area through clearances in the associated porous metallic member with coming into collision contact against the over-all surface of the porous metallic member, the remaining heat in the hot fluid is first transferred to the solid of the porous metallic member, and then to the wall of metallic sheet. The heat is eventually transmitted to another fluid in the heat-emitting area or colder area. To make certain of smooth heat transmission between the two fluids, it would be conceived that the porous metallic members have to be securely joined together with the wall through their stems that come in engagement with the sides of the wall.

Moreover, it is necessary to employ the heat exchanger high in efficiency in order to realize the effective reclaiming of heat energy from the exhaust gases. With the engines of turbo-compound type employing the fuel of natural gas, the combustion chamber needs heat insulation to exploit the most of heat energy from the exhaust gases, converting the most of energy derived from the fuel into power. Effectiveness in the heat exchanger is very crucial for the heat transfer from one fluid to another. That is, the higher the effectiveness in the heat exchanger is, the better it is for available rate of heat energy and therefore for the over-all thermal efficiency. The operating fluids have considerable affect on the effectiveness of the heat exchanger in their heat conductivity and heat transfer rate, and also less thermal resistance is preferred for smooth transmission of heat.

SUMMARY OF THE INVENTION

The present invention, therefore, has as its primary object to overcome the subject as recited just above and to provide a heat exchanger that is applicable well, for example to the thermal decomposition of natural gas to produce reformed fuel, the conversion of water into steam, the condensing of a vapor to a liquid, the warming of an oily substance, and so on. More particularly, it provides a heat exchanger in which a porous metallic member is joined integrally with a partition wall with stems thereof being connected to the partition wall in a physically continuous condition sharing the same physical properties with the partition wall, thereby bringing triple to fifth-fold improvement in coefficient of overall heat transmission to transmit the heat energy in the heat-extracting area or hotter area to the heat-emitting area or colder area, thus eventually increasing the effectiveness in the heat exchanger. According to the present invention, the improvement in coefficient of overall heat transmission as stated earlier can be achieved by employment of junction layers that are interposed between the porous metallic members and the surface areas of the partition wall preparatory to joining together them to avoid the occurrence of any thermal interruption in the joined zones, thereby increasing the effectiveness in the heat exchanger.

Another object of the present invention is to combine the heat exchanger constructed as recited earlier together with a turbo-generator system. A Rankine cycle engine is employed together with a heat exchanger installed in an exhaust line for the high reclaiming of heat energy remaining in the exhaust gases. In the heat exchanger installed in the exhaust line as stated earlier, a porous metallic member lying in the flow of exhaust gases is joined integrally with a partition wall defining a passage to allow a fluid to pass through there. The porous metallic member is merged with the partition wall in physically continuous condition sharing the same physical properties with the partition wall, thereby bringing triple to fifth-fold improvement in coefficient of overall heat transmission to transmit the heat energy in the hotter area to the colder area, thus eventually increasing the effectiveness in the heat exchanger.

The present invention is concerned with a heat exchanger in which heat is transferred from a heat-extracting area where a fluid is allowed to flow through there to a heat-emitting area where another fluid different in temperature from the fluid is allowed to flow through there, wherein a wall is provided to separate the areas from one another, and porous metals are provided in the areas, one to each area, the porous metals being each made on a surface thereof with a junction layer of pasty joining material kneaded with powdery metal, the porous metals being each merged together with the wall through fusion of the associated junction layer to make certain of heat transfer between the wall and the porous metal.

In one aspect of the present invention, a heat exchanger is provided in which the porous metal is made of at least one metal selected from nickel, nickel-chrome alloy, copper and aluminum, while the wall is made of an alloy of copper and any one of nickel and nickel chrome alloy, and the powdery metal is of a heat-resisting metal superior in heat conductivity, selected from silver, nickel, copper and zinc.

In another aspect of the present invention, a heat exchanger is provided in which the junction layers are buried in the porous metals in a way coming into contact with opposite sides of the wall, one to each side, and any first junction layer has a high heat-resisting property and the second junction layer has a fusing temperature more than 100° C. lower than the one, the first junction layer being made of joining material higher in fusing temperature than the second junction layer. In a further another aspect of the present invention, a heat exchanger is disclosed in which the porous metals has a stem while the junction layers are bonded to the porous metals in a way the stem is either buried into the associated junction layer in a depth not less than a diameter of the stem in cross section or surrounded with the junction layer in a conical shape.

In another aspect of the present invention, a heat exchanger is provided in which at least one metal of high heat conductivity selected from copper, aluminum and silver is coated on the surface of the porous metals by any one process of plating, dipping and vacuum evaporation. In a further another aspect of the present invention, the porous metals are each made with a groove on a surface thereof opposite to the surface bonded with the associated junction layer, the groove extending along flow of the fluid.

In another aspect of the present invention, a heat exchanger is provided in which the porous metals are applied over the surface thereof with a ceramic coating of alumina or zirconia over which is distributed at least one catalyst selected from platinum, vanadium, rhodium, ruthenium and cerium oxide. In another aspect of the present invention, a heat exchanger is provided in which the porous metal is coated over the surface thereof with a plating layer of at least one material high in heat conductivity selected from copper, silver and aluminum, the plating layer varying gradually in thickness across the junction layer. In a further another aspect of the present invention, the gradual variation in thickness of the plating layer over the surface of the porous metal is done by varying a time it takes for dipping the porous metal in a plating bath. As an alternative, an aluminum coating layer is made over the surfaces of the porous metal and then subjected to heat-treatment to precipitate $\alpha$-alumina structure.

With the heat exchanger constructed as stated earlier, the fins or porous metallic bodies come into merging integrally with the opposite surfaces of the wall through the junction layers without causing any local area where heat-transmission is obstructed, helping improve the heat conductivity between the porous metallic bodies and the separating wall, thereby largely increasing the effectiveness of the heat exchanger. Three-dimensional open-cell arrays in the porous metallic body installed in both the heat-extracting or hotter area and the heat-emitting or colder area in the heat exchanger helps provide largely extended surfaces coming in fluid-to-surface contact with the fluids including natural gas, exhaust gases, and so on, which are allowed to flow through the porous metallic body, thus largely raising the effectiveness of the heat exchanger.

In another aspect of the present invention, there is provided a heat exchanger applicable well to a turbo-generator system including an exhaust turbine extracting energy from exhaust gases exhaled out of the heat source of an engine or a combustor, a first heat exchanger unit installed with a porous metal to generate high-temperature steam by a remaining energy in the exhaust gases leaving the exhaust turbine, a steam turbine extracting energy from a high-temperature steam generated in the first heat exchanger unit, an electric generator having a rotor shaft connected to the exhaust turbine and the steam turbine at axially opposite ends thereof, a condenser for removing heat from a steam discharged out of the steam turbine to reduce the steam to a liquid, the condenser being comprised of a porous metal installed on a tubing that allows the steam to pass through there, a pump to feed a water produced in the condenser into the first heat exchanger unit, and a second heat exchanger unit installed between the pump and the first heat exchanger unit to convert the water forced through the pump into a steam by using a hot oil recirculating through the heat source.

In another aspect of the present invention, a heat exchanger is provided in which the first heat exchanger unit has an outer cylinder filled with a porous metal where the exhaust gases are allowed to pass through there, and an inner cylinder nested in the outside cylinder and packed inside with a porous metal where a steam is allowed to flow through there, the inner cylinder being joined on-an outside surface thereof with the porous metal inside the outer cylinder while on an inside surface thereof with the porous metal inside the inner cylinder through fusing metal so that the inner cylinder serves as a wall isolating the porous metals on opposite surfaces thereof from one another. In a further another aspect of the present invention, the porous metals on opposite surfaces of the wall in the first heat exchanger unit are joined together with the wall by fusing the junction layers of pasty joining material buried into the porous metals. Moreover, a heat insulator surrounds around a periphery of the outer cylinder, and the porous metal installed inside the outer cylinder is higher in porosity than the porous metal enclosed in the inner cylinder.

In another aspect of the present invention, a heat exchanger is provided in which the inner cylinder is made in a way that a flow passage for the stream is made smaller in cross sectional area at an egress thereof than an ingress thereof to get a velocity of the stream faster at the egress. In a further another aspect of the present invention, a heat exchanger is provided in which a porous metal or a fin is installed on a steam line midway between the steam turbine and the condenser to cool down the steam leaving the steam turbine. Moreover, the condenser is comprised of an inside liquid chamber having a porous metal, an outside chamber for cooling gas or liquid in which a porous metal is installed, a wall separating the inside and outside chambers from one another, and a steam passage extending in the liquid chamber to deliver the steam leaving the steam turbine into the liquid chamber.

In another aspect of the present invention, a heat exchanger is disclosed in which the porous metal in the in the liquid chamber of the condenser is made up of a plurality of multistage porous metallic sheets, which are penetrated with the steam passage at the center thereof and joined with the wall separating the liquid chamber from the gas or liquid, so that the steam is discharged out of the steam passage into the liquid chamber, where the steam passes through the porous metallic sheets with losing a remaining energy in the steam. Moreover, the porous metal in the outside chamber for cooling gas or liquid is joined together with the wall to cool down the steam discharged out of the steam turbine, so that the condenser is made in either an air-cooled system where air is forced into the outside chamber by a blower or a water-cooled system where cooling water is forced to pass through there.

In another aspect of the present invention, a heat exchanger is provided in which the porous metal installed in the liquid chamber is made of porous material of nickel coated with at least one corrosion resisting metal including silver, copper and aluminum, while the porous metal in the outside chamber for cooling air or liquid is made of nickel-based porous metal coated with aluminum.

In another aspect of the present invention, a rotor shaft surrounded with a permanent-magnet rotor of the generator is flanked with the steam turbine and the exhaust turbine, one to each flank.

In another aspect of the present invention, electric power produced by the generator is supplied to either a motor to drive a compressor to force air into the heat source or a motor to spin a crankshaft of the engine through an inverter.

In another aspect of the present invention, there is a heat exchanger applicable to a fuel-reforming system installed in an exhaust line from an engine to convert a natural gas into a reformed fuel of $H_2$ and CO by using heat energy of exhaust gases of the engine where the reformed fuel ignites and burns.

In another aspect of the present invention, the fuel-reforming system has absorption means to absorb $CO_2$ out of the exhaust gases, and catalyst means to help convert the natural gas into the reformed fuel, whereby heat energy is reclaimed from the exhaust gases.

In another aspect of the present invention, the fuel-reforming system includes a cylindrical shell having inlet ports and outlet ports, an circular rotary vessel supported for rotation in the cylindrical shell and provided therein with radial partition plates to form compartments juxtaposed in circular direction, porous metals accommodated in the compartments, the porous metals having a absorbing material and a catalyst thereon, and the exhaust line, steam line and natural gas line are communicated respectively to the inlet and outlet ports in the cylindrical shell.

In a further another aspect of the present invention, the fuel-reforming system includes valve means to control sequential flows of exhaust gases from the exhaust line, steam from the steam line, and natural gas fuel from the natural gas line into the rotary vessel.

With the heat exchanger constructed as stated earlier, the porous metal lying in the flow of fluid provides surface extension enough to make sure of high efficiency of the heat exchanger. For reusing the heat energy stored in the exhaust gases from the engine to convert a liquid into a vapor or reduce a spent vapor to a liquid, the heat exchanger needs high efficiency.

Now considering theoretically about the heat transmission from a hot gas to a solid in the heat exchanger, the greater the gaseous body is in heat transfer rate, the more heat is transferred. Heat transfer rate of the gaseous body is determined depending on Reynolds' number expressed as a function of the velocity and the kinematic viscosity, Prandtl number representing physical characteristics of gaseous body, the heat conductivity, and Nusselt number expressed as a function of Reynolds' number. The relation is written as $$\alpha g1 = Nu \cdot \lambda / X$$

$$Nu = K \cdot Re^m \cdot Pr^n$$

$$Re = U \cdot X / \nu$$

where $\alpha g1$ is heat transfer rate, Nu is Nusselt number, $\lambda$ is heat conductivity, K is constant, Re is Reynolds' number, Pr is Prandtl number, U is representative velocity, $\nu$ is kinematic viscosity, and X is representative length.

It will be said that of all terms in the relations stated earlier, the most far-reaching terms on heat transfer rate is Reynolds' number, which is a function of velocity. When a fluid flows over a surface of solid, the fluid just adjacent to the solid surface would have no velocity, and the farther away the fluid is from the solid surface, the faster the fluid flows over the solid surface. Thus, Reynolds' number is determined depending on flow characteristics neighboring the solid surface.

Moreover, the following conditions will be considered to increase the heat transmission from a gaseous body to the solid:

1. Contact area of the solid with the gaseous body is increased when the gaseous body flows over the solid:

2. The solid is dispersed widely in the form of continuous net in the flow of gaseous body:

3. The heat-transfer solid to absorb the heat is made of a material superior in heat transfer rate to transfer much heat to a partition wall installed between two fluids in the heat exchanger:

4. The heat-transfer solid to absorb the heat is joined integrally with the partition wall to make sure of effective heat transmission:

5. The transferred heat is effectively desorbed through the heat-transfer solid in colder fluid.

FIG. 1 is a schematic view of a basic model that would implement all the conditions 1–5 stated just above. For much heat transfer in the heat transfer/transmission systems, it will be preferred to curb the velocity of gaseous body while increase the area of heat-transfer surface, rather than raising the velocity of gaseous body to increase Reynolds' number, thereby growing the quantity of transferred heat.

Now, the heat-transfer from heat extraction to the heat emission in the heat exchanger will be figured out later with reference to FIGS. 1 and 2. The quantity Q of heat transferred in the heat exchanger having fluid passage of a circular tubing 4 with a fin 3 as shown in FIG. 2 is linked to coefficient of overall heat transmission K (unit: $W/m^2 \cdot K$) as defined by:

$$Q = K \cdot Ar \cdot \Delta T$$

in which Q is quantity of heat transferred, K is coefficient of overall heat transmission, Ar is reference area, and $\Delta T$ is temperature difference.

Moreover, the coefficient of overall heat transmission K when heat is transmitted between fluids inside and outside through a tube wall 4 with a fin 3 as in FIG. 2 is given by a general formula 1:

$$\frac{1}{K} = \frac{1}{hi} + \frac{di}{2\lambda} \cdot \ln\frac{do}{di} + \frac{di}{do\ ho(Af\phi f + Ab)/Ar}$$

where hi is heat transfer rate on radially inside surface ($W/m^2 \cdot K$), ho is heat transfer rate on radially outside surface ($W/m^2 \cdot K$), $\lambda$ is heat conductivity of a tube, di is inside diameter of a tube wall (m), do is outside diameter of a tube wall (m), Af is fin-mounted area ($m^2$) inside the tube wall, $\phi f$ is fin efficiency, Ab is outer peripheral area ($m^2$) between adjacent fins, Ar is reference area (outer peripheral area corresponding a pitch of successive fins, $m^2$), and ln is natural logarithm.

The term ln (do/di) in the formula stated earlier is modified with [di/2] ln(do/di) when the tube wall 4 has a large difference between do and di, and moreover modified with do/di ($Af\phi f+Ab$)/Ar for fin-mounted tube wall 4. The reason is that the area of heat-transfer surface so much varies relatively to reference area.

With the tube wall 4 there is not much difference between do and di, the coefficient of overall heat transmission K is expressed by the following general formula 2:

$$\frac{1}{K} = \frac{1}{hi} + \frac{(di - do)}{\lambda} + \frac{1}{ho(Af\phi f + Ab)/Ar}$$

Based on the above, the basic principle on the effectiveness of the heat exchanger will be considered as explained in the following with reference to FIGS. 1 and 2.

Heat is transmitted from hot gas GA in a heat-extracting or hotter area 7, referred to hotter area 7 hereinafter, to a cold gas GB in a heat-emitting or colder area 8, referred to colder area 8 hereinafter, through a partition wall 2 separating the two gases from one another. In both the hotter and colder areas 7 and 8, there is provided a porous metallic body 1, one to each area, which has many stems 5 integrally merged together with the partition wall 2 with the help of any one of junction layers 9, 10, the porous metallic body 1 itself is made up of many stems 5 and twigs or whiskers 6 branching from the stems 5, which are randomly dispersed and entangled on themselves to form open-cells. It is normally said that the coefficient of overall heat transmission K is linked to heat transfer rates on hotter and colder areas. For the heat exchanger in which the partition wall 2 separating the two fluids is made over the opposite surfaces thereof with either fins 3 (refer to FIG. 2) or the porous metallic body 1, nevertheless, experimenting results suggested that any extended surface effect must be considered to get test results tallying with the theoretical coefficient of overall heat transmission K. With the heat exchanger of the basic principle model in FIG. 1 to enlarge or increase the heat-transfer surfaces in the hotter and colder areas, it will be considered that the heat-transfer surface made up of the stems 5 and twigs 6 branching away in all directions can amplify the coefficient of overall heat transmission K three to five times. Thus, it remains a major challenge to solve the issues of how to increase the contact areas with the fluids to raise the coefficient of overall heat transmission in the heat exchanger, especially, how to make the porous metallic body merge integrally together with the partition wall separating the two fluids from one another.

With the heat exchanger of the present invention constructed according to the basic principle as stated earlier, the porous metallic body comes into merging integrally with the partition wall through the junction layer without any local area where heat-transmission is obstructed, helping improve the heat conductivity between the porous metallic body and the partition wall, thereby largely increasing the effectiveness of the heat exchanger. Three-dimensional open-cell arrays in the porous metallic body installed in both the hotter and colder areas in the heat exchanger helps provide large surface extension coming in fluid-to-surface contact with the fluids including natural gas, exhaust gases, and so on, which are allowed to flow through the porous metallic body, thus largely raising the effectiveness of the heat exchanger.

DETAILED DESCRIPTION OF THE PREFERRED EMBODIMENTS

Preferred embodiments of a heat exchanger according to the present invention will be explained hereinafter in detail with reference to the accompanying drawings.

Figure 1:
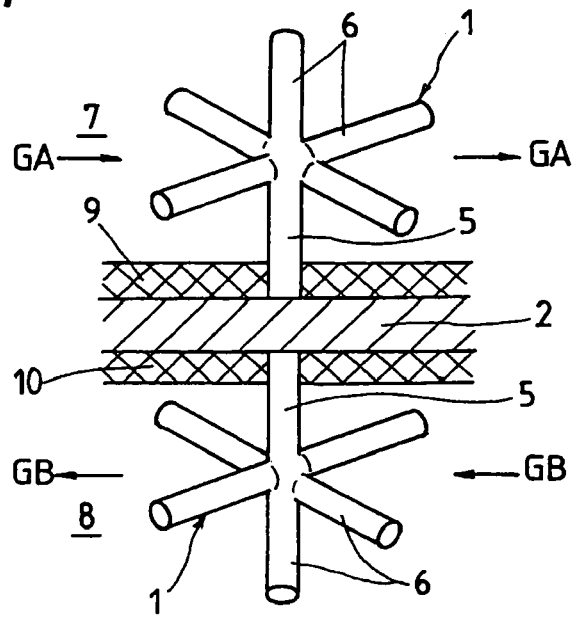
FIG. 1 is a conceptual schematic view to explain a basic principle of a heat exchanger in accordance with the present invention.
Figure 2:
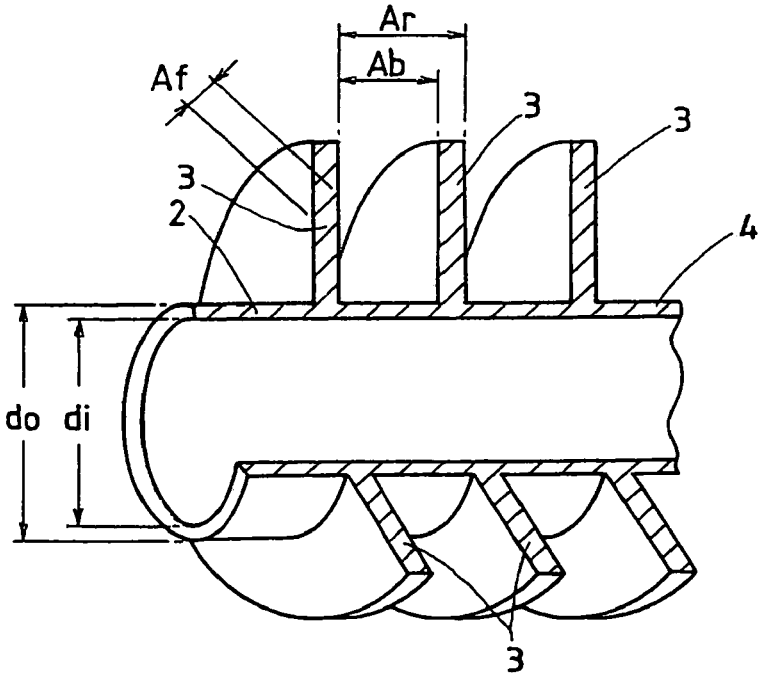
PRIOR ART FIG. 2
FIG. 2 is a schematic view to explain coefficient of overall heat transmission in a tube circular in cross section.
Figure 3:
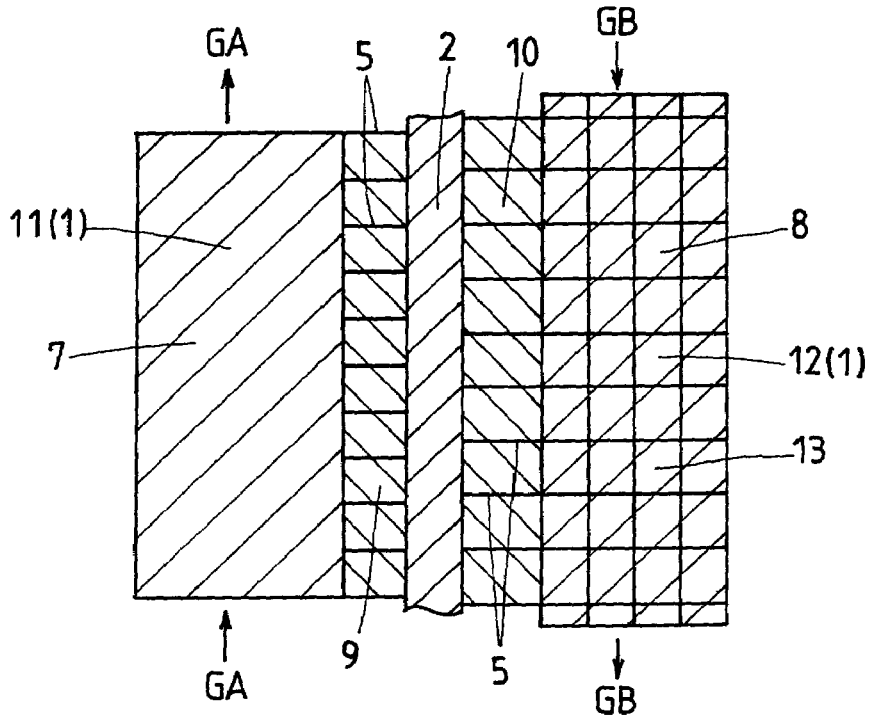
FIG. 3 is a schematic illustration of a model to imagine how heat flows through across the heat exchanger of the present invention.

With the heat exchanger of the present invention, as shown in FIG. 3, any one of two fluids at different temperatures or a hot fluid GA flows through a hotter area 7 while another fluid or a cold fluid GB flows through a colder area 8. Heat is transferred from the hotter area 7 to the colder areas 8. The hot fluid is, for example, heated exhaust gases coming out of any heat source including engines and combustors, whereas the cold fluid is cool natural gases that will be pyrolyzed to produce a reformed fuel.

Figure 4:
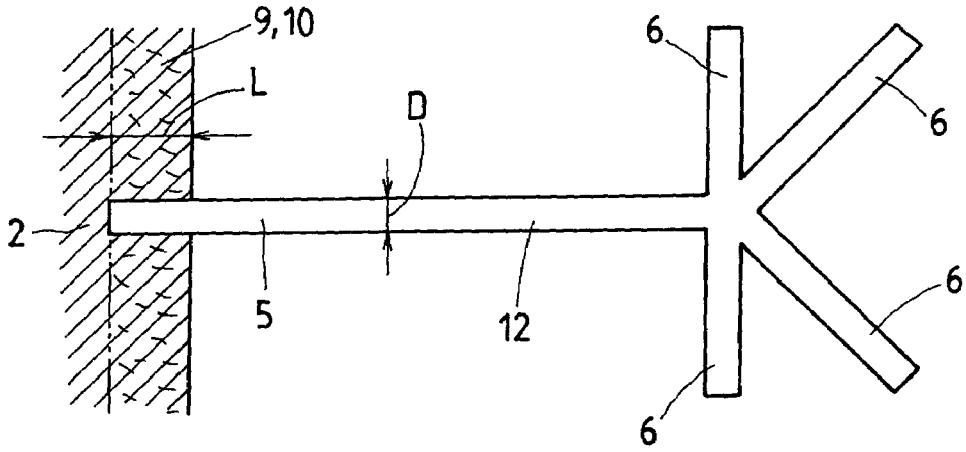
FIG. 4 is a schematic view showing a model at a colder area side of the heat exchanger of the present invention.

The heat exchanger has partition wall 2 to separate the hotter area 7 and the colder area 8 from one another, where porous metallic members 11, 12 (the entire porous metallic member is designated by reference number 1) are disposed, one to each area, and joined to opposite side surfaces of the partition wall 2. The porous metallic body 1 has many stems 5 that are joined or merged together with the partition wall 2 through junction layers 9, 10, the partition wall 2 being made of any metal superior in heat conductivity. The stems 5, as seen in FIG. 4, each branch out into many twigs or whiskers 6. The stems 5 may be varied in their cross section depending on whether they are in the hotter area 7 or in the colder area 8.

With the heat exchanger of the present invention, moreover, junction layers 9, 10 made a paste of joining material kneaded with any powdery metal are applied over an outside surface of the porous metallic body 1 in a way filling in open-cells in a depth from the outside surface. The junction layers 9, 10 over the porous metallic body 1 are brought into close contact with the partition wall and subjected to sintering to join the porous metallic body 1 together with the partition wall 2. The powdery metal kneaded in the joining material to make the paste is selected from any metals rich in corrosion-resistant and heat-resistant properties, including silver, nickel, copper, zinc, aluminum, and so on. The porous metallic body 1 is composed of a metal selected from nickel, copper, aluminum, and so on. The partition wall 2 is made of a metal high in heat conductivity including nickel, copper, and so on. Moreover, the powdery metal contained in the junction layers 9, 10 is composed of a heat-resistant metal superior in heat conductivity including silver, nickel, copper, zinc, and so on.

Of the junction layers 9, 10 disposed across the partition wall 2, the first junction layer 9 buried in the porous metallic member 11 in the hotter area 7 has a heat-resistance enough to suffer higher temperature whereas the second junction layer 10 buried in another porous metallic member 12 in the colder area 8 has a moderate resistance endurable about 100° C. relatively colder than in the first junction layer 9. Thus, the first junction layer 9 is made of such a material that sintering may be done with a temperature below that in the second junction layer 10. To ensure the porous metallic members 11, 12 merge together into the opposite sides of the partition wall 2, the first junction layer 9 buried into the porous metallic member 11 in the hotter area 7 is first placed in close contact with the associated side of the partition wall 2 and then sintered at elevated temperature to join securely the porous metallic member 11 with the partition wall 2 through the sintered first junction layer 9. Subsequently to the sintering at elevated temperature stated earlier, the second junction layer 10 buried into the porous metallic member 12 in the colder area 8 is brought in close contact with the associated side of the partition wall 2, followed by being sintered at moderate temperature to join the porous metallic member 12 with the partition wall 2 by virtue of the sintered second junction layer 10, without causing degradation of the sintered first junction layer 9. As an alternative, the partition wall 2 is flanked with the porous metallic body 1 in close engagement with them, which is joined with the partition wall 2 simultaneously at the opposite sides of the wall 2. With the modification stated just earlier, both the first and second junction layers 9, 10 may be made of the same material or any substance substantially equivalent in heat-resistant property.

The porous metallic member 11 is covered over the outside surface thereof with any metal superior in heat conductivity, including copper, silver, aluminum, and so on, by means of any coating including metal plating, dipping, vacuum evaporation, and do on. On the other hand, another porous metallic member 12 is applied over the outside thereof with any ceramic skin including alumina ($Al_2O_3$), zirconium oxide ($ZrO_3$), and so on, on which ceramic skin is distributed a catalyst layer 13 including platinum, vanadium, nickel, rhodium, ruthenium, cerium oxide ($Ce_2O_3$), and so on for catalytic reforming of, for example natural gas.

Figure 5:
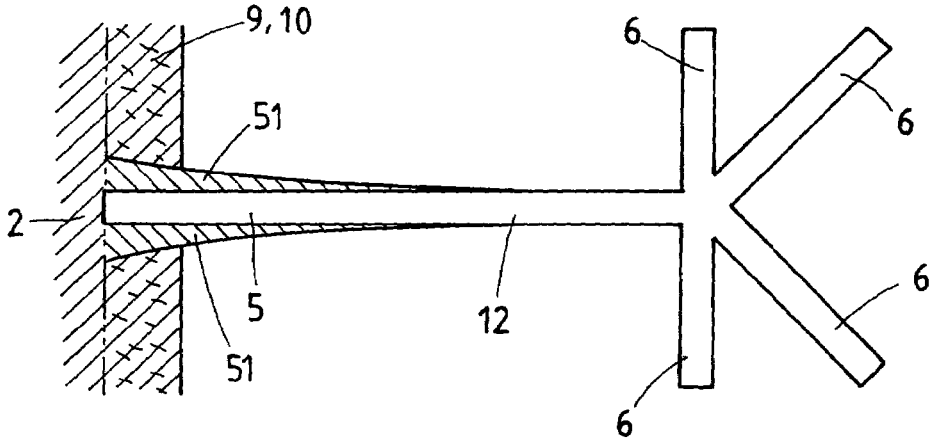
FIG. 5 is a schematic view of a model to illustrate how a plating layer varies at a colder area side of the heat exchanger of the present invention.

Moreover, the plating layer 51 of any metal high in heat conductivity such as copper, silver, aluminum and the like, as shown in FIG. 5, is applied over the porous metallic members 11, 12 in a way varying gradually in thickness across the junction layers 9, 10. Gradual change in thickness of the plating layer 51 on the porous metallic members 11, 12 as in FIG. 5 can be made by varying the time it takes for dipping the porous metallic members 11, 12 in a solution containing the desired surface material. Moreover, aluminum coating layer is made on the surfaces of the porous metallic members 11, 12 and then subjected to heat-treatment to precipitate a corundum crystalline of α-alumina structure, which helps enhance the porous metallic members 11, 12 in mechanical strength and corrosion resistance, and also form much roughness including voids or cells over the outside surfaces of the porous metallic members 11, 12 to provide a largely extended surface area, thereby improving the effectiveness of the heat exchanger.

Figure 6:
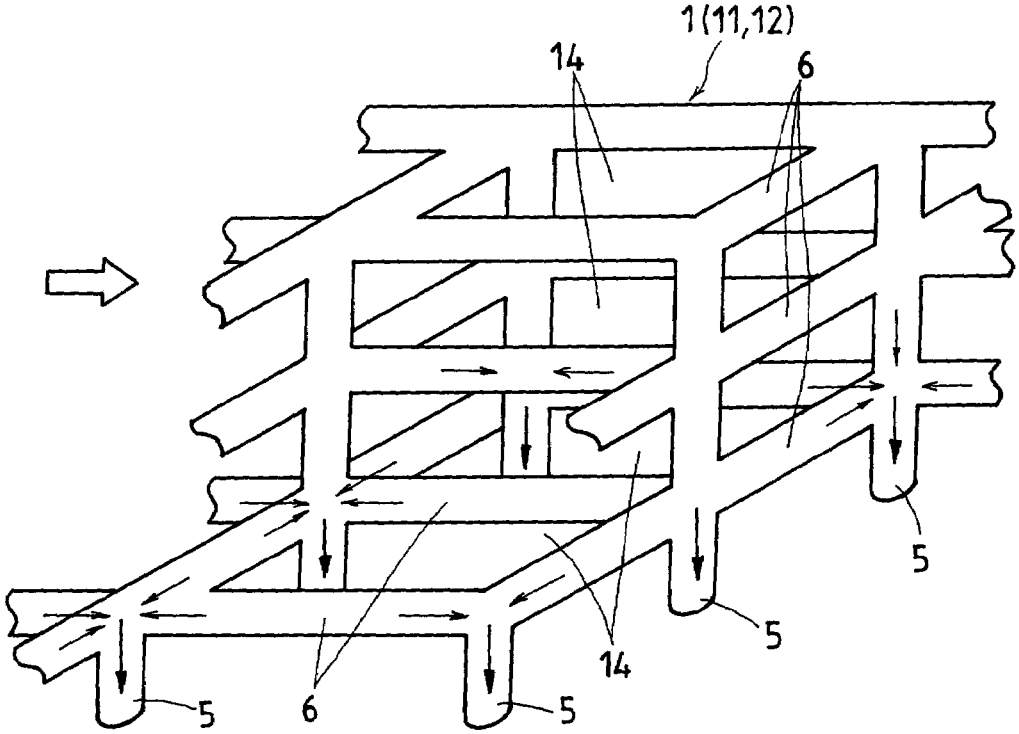
FIG. 6 is a schematic view of a model to explain how heat flows at a hotter area side of the heat exchanger of the present invention.

FIG. 4 shows schematically a unit area to imagine a stem 5 joined with the partition wall 2, along with twigs 6 branching out from the stem 5 of the porous metallic member 12 in the colder area 8. In the junction layers 9, 10 on the porous metallic members 11, 12, the stem 5 of the porous metallic member 12 comes into engagement with the partition wall 2 in a way buried in a depth L more than a diameter D of the stem 5 in cross section. Thus, the porous metallic members 11, 12 come into joining at their many stems 5 together with the partition wall 2 through the junction layers 9, 10. Many twigs 6, as shown in FIG. 6, get entangled and intersected with each other to leave clearances among them, which provide open-cells 14 to make sure of smooth flow of fluids GA, GB. With the porous metallic members 11, 12 constructed as stated earlier, the hotter area 7 helps provide a largely extended heat-extracting surface area making contact with the hot fluid to transmit heat energy from the fluid to the partition wall 2 while the colder area 8 provides a heat-emitting contact area with the cold fluid, which is largely extended enough to make certain of smooth transmission of heat from the partition wall 2 to the cold fluid.

Alternatively, there may be made any grooves, not shown, along the flow direction of the cold fluid GB on a surface of the partition wall 2, which is in opposition to a surface of the wall 2 on which there is attached the junction layer 9 on the side of the hotter area.

Figure 7:
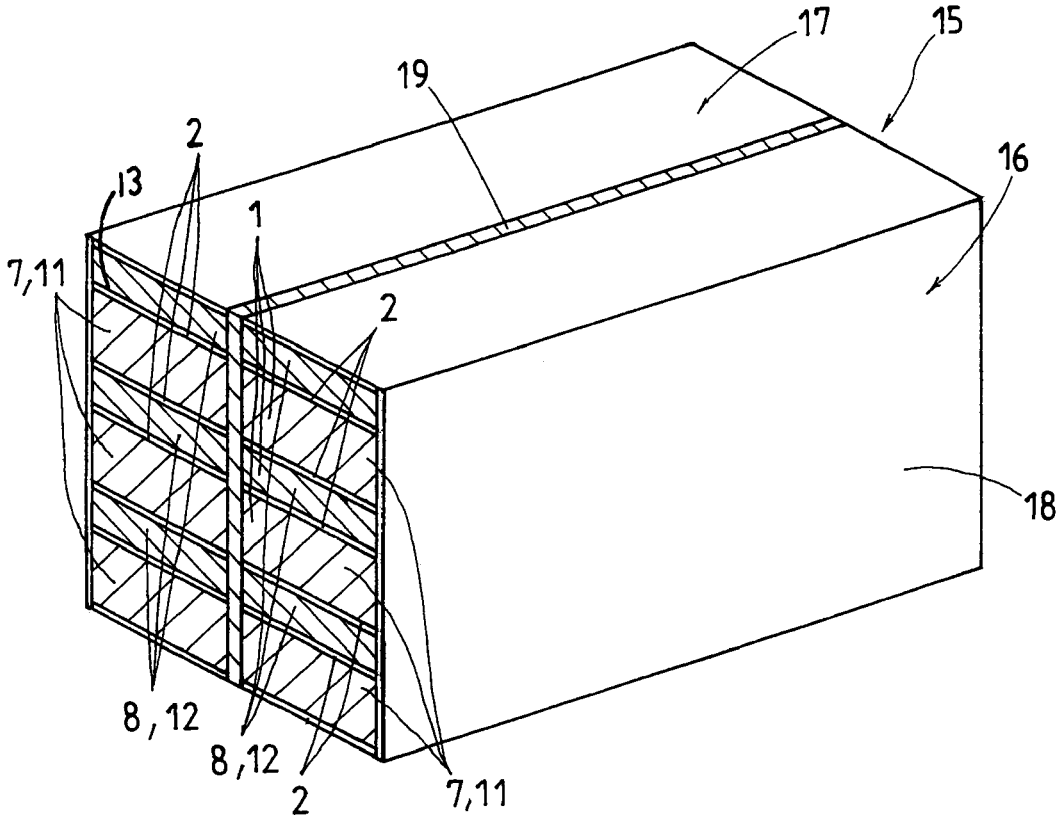
FIG. 7 is schematic view illustrating a model of the heat exchanger of the present invention, which is applied to a fuel-reforming system.

The heat exchanger of the present invention is suited, for example, for a fuel-reforming system 15 as in FIG. 7. The fuel-reforming system 15 includes a pair of heat exchanger units 16, 17, which are equal in construction with one another and contained in an enclosure 18. The two heat exchanger units 16, 17, one for reforming a natural gas and the other for capturing $CO_2$ gas, work sequentially, alternatively to pyrolyze the natural gas with heat energy of exhaust gases in the presence of $CO_2$ gas. The two heat exchanger units 16, 17 are separated from one another through a thermal isolation layer 19. The heat exchanger units 16, 17 are each made in a layered construction where there are provided the hotter area 7 to allow the exhaust gases to flow through there, the colder area 8 for the natural gas, and the partition wall 2 interposed between the hotter area 7 and the colder area 8 to separate them from one another. The colder area 8 is filled with porous metallic member 12, on the surface of which a catalyst layer 13 (shown, for example on only one of the surfaces of porous metallic members 12 in FIG. 7) is distributed to promote the pyrolysis of, for example the natural gas flowing through the 4 colder area 8. The hotter area 7 has the porous metallic member 11 therein, which is coated with any absorbent including zeolite, lithium zirconate, and so on to recover $CO_2$ gas from, for example the low-temperature exhaust gases. It will be understood that the captured $CO_2$ gas will be used for the pyrolysis of natural gas.

The fuel-reforming system 15 is, for example, arranged downstream of an exhaust pipe of an engine to convert the natural gas into the reformed fuel in the presence of any catalyst by using the heat energy reclaimed from the exhaust gases. The fuel-reforming system 15 is installed on a turning shaft in any housing with the enclosure 18 being made with gas lines opened to other systems. The enclosure 18 is divided into the two heat exchanger units 16 and 17, which are each separated into the hotter area 7 and the colder area 8, which are isolated from one another by means of the partition wall 2. The high-temperature exhaust gases flows into the hotter area 7 at an upstream ingress, followed by passing through the hotter area 7 and leaving the area 7 at a downstream egress. The natural gas is charged along with air and vapor at an upstream ingress into the colder area 8 in which the catalyst is distributed. In the colder area 8, the natural gas is reformed in the presence of the catalyst and the reformed fuel leaves the colder area 8 at a downstream egress.

With the fuel-reforming system 15 constructed as stated earlier, the $CO_2$ gas needed for pyrolysis of the natural gas is captured out of the low-temperature exhaust gases in absorptive reclamation on the porous metallic member 12. To this end, the high-temperature exhaust gases are first led through the porous metallic member 11 in the hotter area 7 of any one heat exchanger unit 16, where the hotter exhaust gases results in losing somewhat heat energy, getting a low-temperature exhaust gases. The resultant exhaust gases at low-temperature is then introduced into the porous metallic member 12 in the colder area 8 of other heat exchanger unit 17, where the $CO_2$ gas is absorbed by zeolite and/or by reaction with lithium zirconate. Thereafter, the enclosure 18 makes a half turn. There the high-temperature exhaust gases are admitted to flow through the porous metallic member 11 in the hotter area 7 of the other heat exchanger 17 while the natural gas either alone or added with steam and exhaust gases is allowed to pass through the porous metallic member 12 in the colder area 8 of the heat exchanger unit 17, whereby the heat energy transferred from the hotter exhaust gases flowing through the hotter area 7 converts the natural gas into the reformed fuel of hydrogen and carbon monoxide in the colder area 7. Thus, the reforming of the natural gas can be successively done by carrying out repeatedly the procedures stated earlier.

With the fuel-reforming system 15 constructed as stated earlier, the porous metallic body 1 filling in both the hotter and colder areas 7, 8 can emit radiation heat, helping improve the effectiveness of the heat exchanger, use the heat energy stored in the exhaust gases to rearrange the natural gas in properties, thereby converting major component: $CH_4$ in the natural gas into $H_2$ and CO. The reclaiming of $CO_2$ gas from the exhaust gases preparatory to the reforming of the natural gas makes it possible to avail the hotter exhaust gases to alter the properties of natural gas in the presence of $CO_2$.

Figure 8:
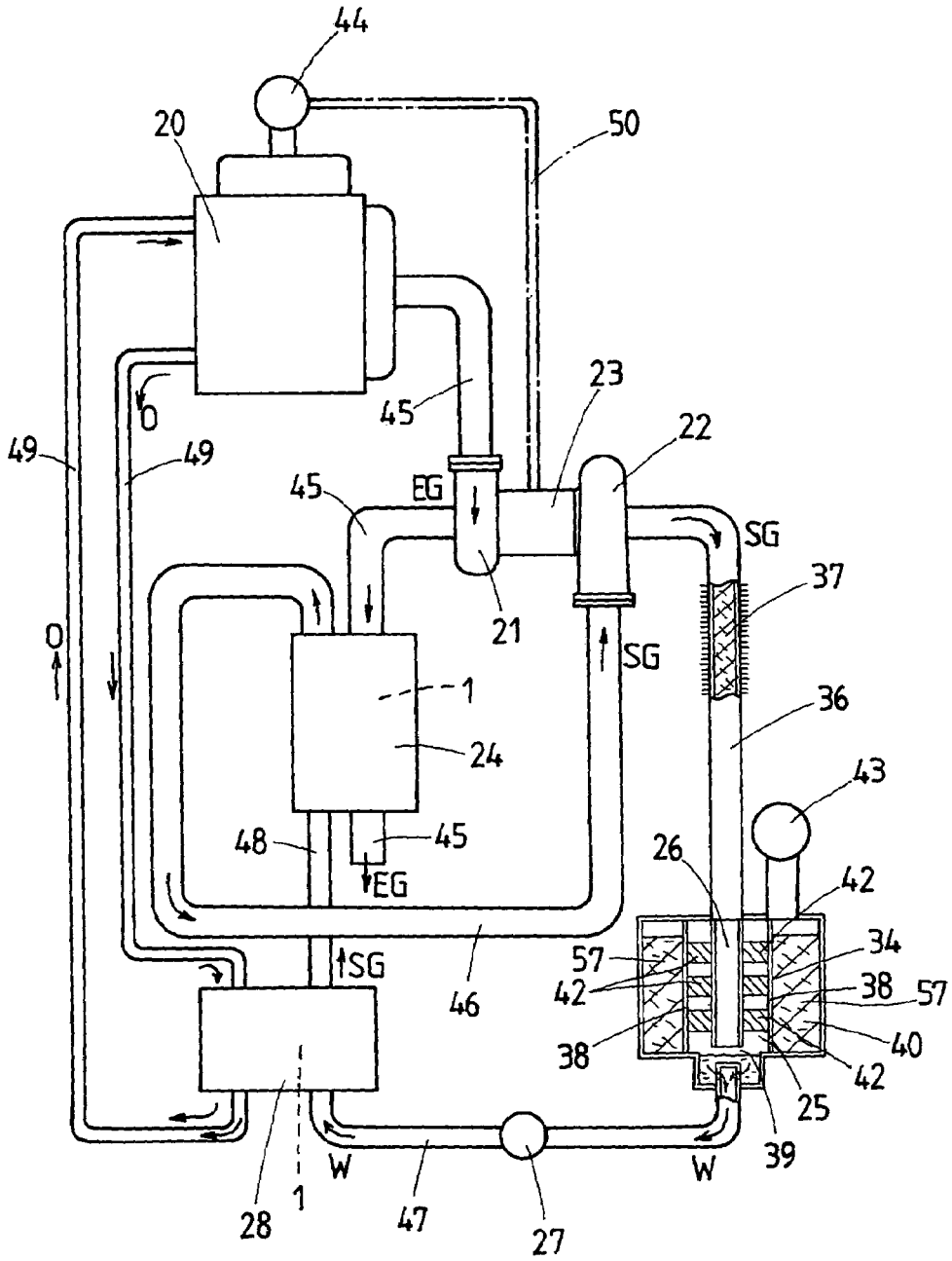
FIG. 8 is a schematic block diagram to explain a basic principle of a turbo-generator system where the heat exchangers of the present invention are incorporated therein.

Next, embodiments of a turbo-generator system combined with the heat exchanger of the present invention will be explained below with reference to FIGS. 8 and 9.

The turbo-generator system includes the provision of a steam turbine improved in possible efficiency to convert heat energy in an exhaust gases from any heat source or engine 20 into either electric or kinetic energy. According to the turbo-generator system stated later, an exhaust turbine 21 needs to be curbed moderately in turbine inlet pressure to relieve the engine 20 from loss of power, which might occur because the engine 20 is exposed to any excess load in exhaust phase thereof. To this end, there is provided a first heat exchanger unit 24 to convert the heat energy stored in the exhaust gases into steam power of elevated stem pressure to drive a steam turbine 22. To actuate the steam turbine 22 with the highest possible efficiency, a condenser 25 of heat exchanger is installed at a steam turbine outlet side. In the condenser 25, the steam having left the steam turbine 22 is reduced down in temperature and pressure, for example, below 0.05 kg/cm$^2$, thus transformed to a liquid state. This helps improve the efficiency of the steam turbine 22.

The turbo-generator system stated earlier includes the exhaust turbine 21 extracting energy from exhaust gases EG exhaled out of the heat source 20 through an exhaust line 45, a first heat exchanger unit 24 installed with the porous metallic body 1 to generate high-temperature steam by the remaining energy in the exhaust gases EG leaving the exhaust turbine 21, the steam turbine 22 extracting energy from a high-temperature steam SG generated in the first heat exchanger unit 24 and fed through a steam line 46, and an electric generator 23 driven with the exhaust turbine 21 and the steam turbine 22, which are connected to a rotor shaft of the generator 23 at opposite ends. The turbo-generator system, moreover, includes the condenser 25 for removing heat from a steam SG discharged out of the steam turbine 25 to reduce the steam to a liquid, the condenser being comprised of a porous metallic material surrounding around a tubing that allows the steam to pass through there, a pump 27 to feed the water W produced in the condenser 25 into the first heat exchanger unit 24, and a second heat exchanger unit 28 installed between the pump 27 and the first heat exchanger unit 24 to convert the water W forced through the pump 27 into a steam by using a hotter oil O recirculating through the heat source 20. In the generator system recited above, Rankine cycle is mainly composed of the first heat exchanger unit 34, the steam turbine 22, the pump 27 and the second heat exchanger unit 28.

Figure 9:
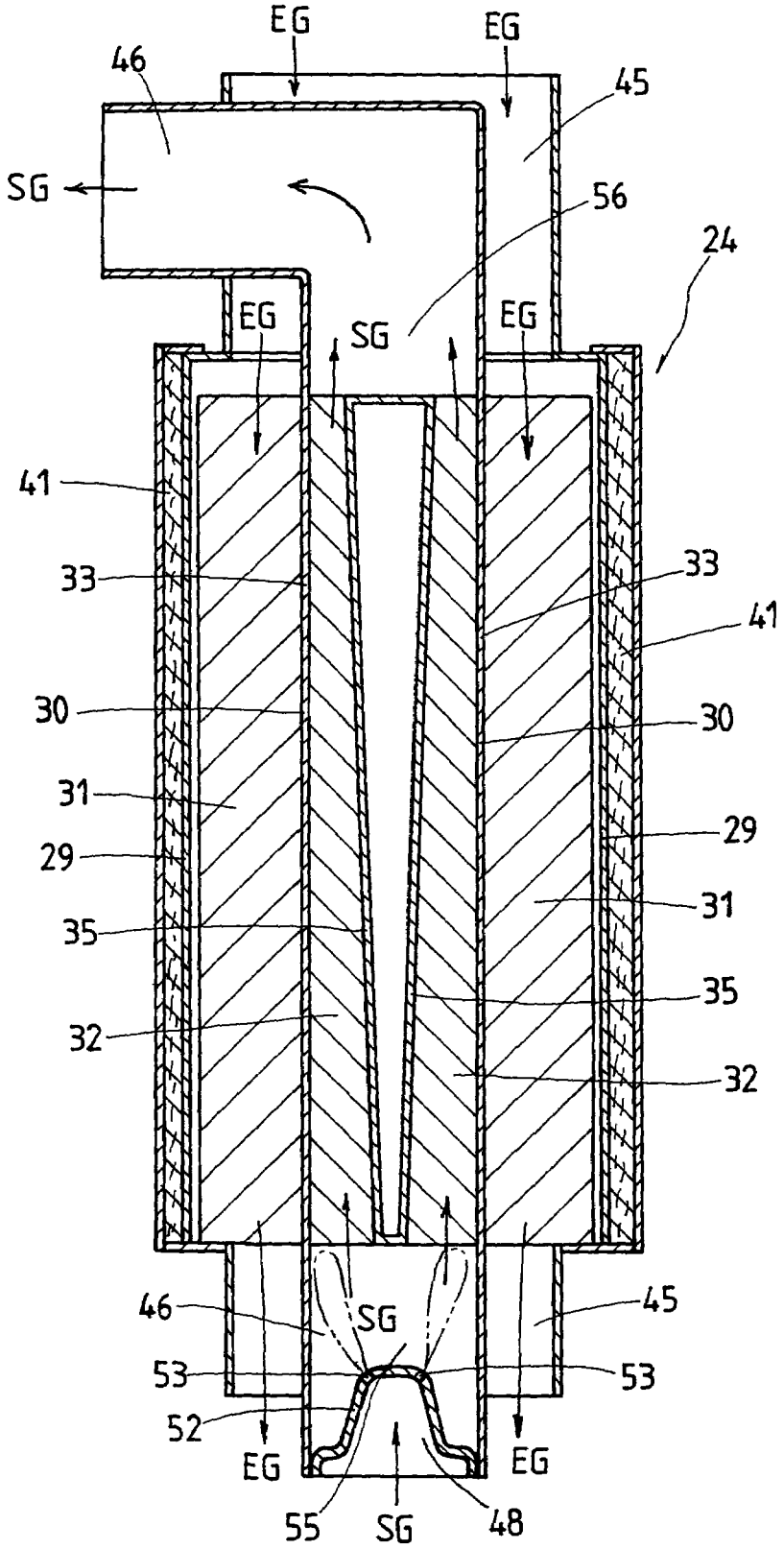
FIG. 9 is a schematic sectioned view of a first heat exchanger incorporated in the turbo-generator system of FIG. 8.

The first heat exchanger unit 24, as illustrated in FIG. 9, has an outer cylinder 29 filled with a porous metallic member 31 where exhaust gases EG are allowed to pass through there, an inner cylinder 30 nested in the outside cylinder 29 and packed inside with a porous metallic member 32 where a steam SG is allowed to flow through there, and a partition wall 33 to isolate the inside of the outer cylinder 29 from the inside of the inner cylinder 30, the porous metallic members 31, 32 being joined with the opposite sides of the partition wall 33 through many stems of the porous members. Thus, it will be understood that the partition wall 33 is constituted with the inner cylinder 30. The porous metallic members 31, 32 lying on opposite sides of the partition wall 33, one to each side, are integrally merged together with the associated surfaces of the partition wall 33 by sintering process of junction layers that are of a paste of joining material kneaded with any powdery metal and buried in the porous metallic members 31, 32.

Around a circular periphery of the outer cylinder 29 of the first heat exchanger unit 24, there is arranged a heat insulator 41 to keep the exhaust gases EG against losing heat energy by radiation. Moreover, open-cellular material for the porous metallic member 31 installed inside the outer cylinder 29 is higher in porosity than another open-cellular material for the porous metallic member 32 enclosed in the inner cylinder 30 to make certain of smooth flow of the exhaust gases to thereby keep the engine 20 against any loss that might be otherwise caused by undue back pressure. Moreover, the inner cylinder 30 nests therein a center wall 35 tapered in a fashion that the flow passage for the stream SG is made smaller in cross sectional area at the side of an egress 56 than an ingress 55 to get the velocity of the stream SG faster at the egress 56, increasing Reynolds' number, thereby raising the heat transfer rate. In this case stated just earlier, it is preferred that the steam line 46 communicated with the egress 56 of the inner cylinder 30 is designed in a way becoming equal in cross section with the egress 56. With this design consideration, the steam SG having increased in velocity during flowing though the inner cylinder 30 will be kept against getting reduced with expansion after the steam SG has left the egress 56 into the steam line 46. Although but the tapered center wall 35 in FIG. 9 is shown made in a way the steam SG flows along the outside of the center wall, it will be appreciated that the taper may be turned upside down to allow the steam SG flowing along the inside of the tapered wall, not shown, and communicating into the steam line 46. Moreover, the steam SG is wet steam and therefore a nozzle 52 is installed in the steam line 48 at the inlet side of the first heat exchanger unit 24 to deliver atomized water jetting out of spray orifices 53 of the nozzle 52 to elevate the heat-transfer efficiency of the first heat exchanger unit 24.

With the turbo-generator system discussed here, moreover, a porous metallic member 37 is arranged in the steam conduit 36 midway between the steam turbine 22 and the condenser 25 to cool down the steam SG leaving the steam turbine 22. The condenser 25 is comprised of an inside liquid chamber 39 having a porous metallic member 34 therein, an outside chamber 40 for cooling gas or liquid in which a porous metallic member 57 is installed, a partition wall 38 separating the inside and outside chamber 39, 40 from one another, and a steam passage 26 extending in the liquid chamber 39 to deliver the steam SG leaving the steam turbine 22 into the liquid chamber 39. Moreover, the porous metallic member 34 in the liquid chamber 39 of the condenser 25 is made up of a plurality of multistage porous metallic sheets 42, which are penetrated with the steam passage 26 at the center thereof and joined with the partition wall 38 along the periphery thereof. The steam SG discharged out of the steam passage 26 into the liquid chamber 39, where the steam SG passes through the porous metallic sheets 42 with losing the remaining energy in the steam, once sufficient heat is eliminated, liquefaction occurs. The porous metallic member 57 surrounding around the partition wall 38 is arranged to extend the heat-transfer surface coming in contact with the cooling gas or liquid flowing through the outside chamber 40.

The condenser 25 to cool down the steam SG leaving the steam turbine 22 is made in either an air-cooled system where air is forced into the outside chamber 40 by a blower 43 or a water-cooled system where cooling water is forced to pass through there. The porous metallic member 34 installed in the liquid chamber 39 is made of porous material of nickel coated with any corrosion resisting metal including silver, copper, aluminum, and so on, while the another porous metallic member 57 in the outside chamber 40 for cooling air or liquid is made of nickel-based porous metallic material coated with aluminum, and so on.

A rotor shaft surrounded with a permanent-magnet rotor of the generator 23 is flanked with the steam turbine 22 and the exhaust turbine 21, one to each flank. Electric power produced by the generator 23 is partially supplied to a motor 44 through a conductor 50 to drive a compressor to force air into the heat source 20. The electric power is in part consumed to drive the motor 44 to spin a drive shaft and a crankshaft to start the engine. On axially opposite ends of the rotor shaft of the generator 23, there are installed the exhaust turbine 21 driven by the exhaust gases EG and the steam turbine 22 driven with the steam SG produced by the heating in the first heat exchanger unit 24. The exhaust gas and steam energies rotate the rotor shaft, torque of which is reclaimed in the electric power through generator 23.

Moreover, the second heat exchanger unit 28 cools down oil heated in recirculating through the engine 20 while converts the water W in Rankine cycle into the steam SG. The heated oil O including engine oil, lubricating oil, and so on recirculating through the engine 20 is fed into the second heat exchanger unit 28 through a hotter oil line 49, while a cooled oil O is fed back to the engine 20 through a colder oil line 49. The water W discharged out of the pump 27 is delivered through a water line 47 as a cooling medium into the second heat exchanger unit 28 where the water W is heated to be converted into a low-temperature steam that is in turn supplied through a steam line 48 into the first heat exchanger unit 24, where the low-temperature steam is boosted in temperature by the transfer of heat from the hot exhaust gases EG, and the resultant high-temperature steam SG is delivered into the steam turbine 22 through a hot steam line 46.

Figure 10:
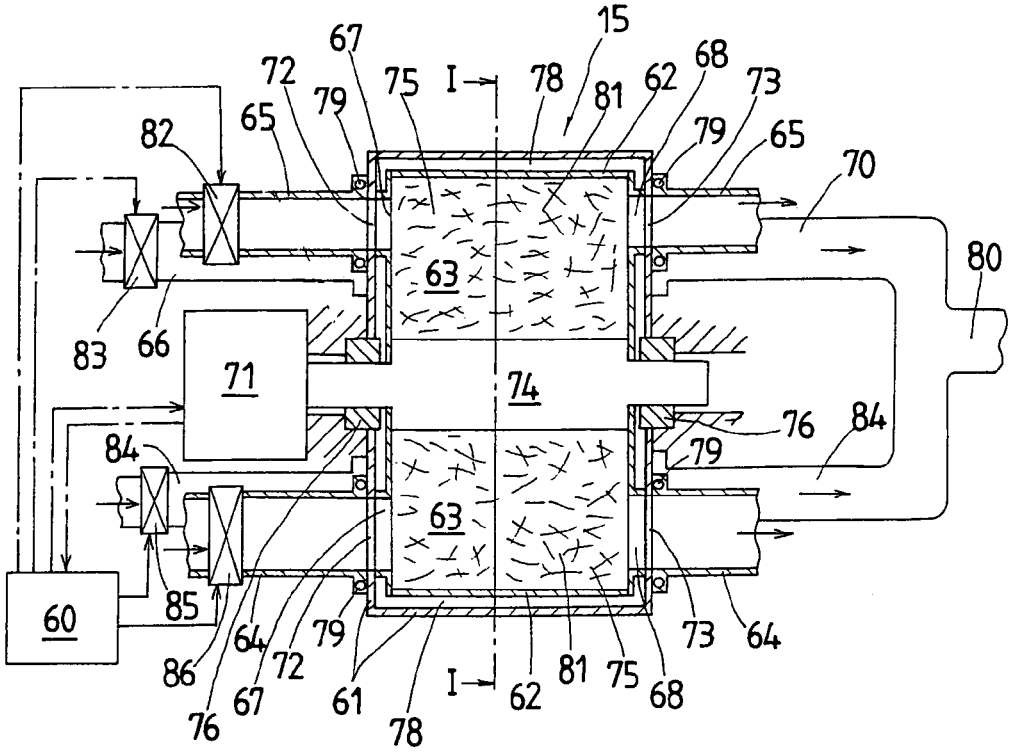
FIG. 10 is a sectional view, partially schematic, showing a preferred embodiment of the fuel-reforming system where the heat exchangers of the present invention are incorporated therein.
Figure 11:
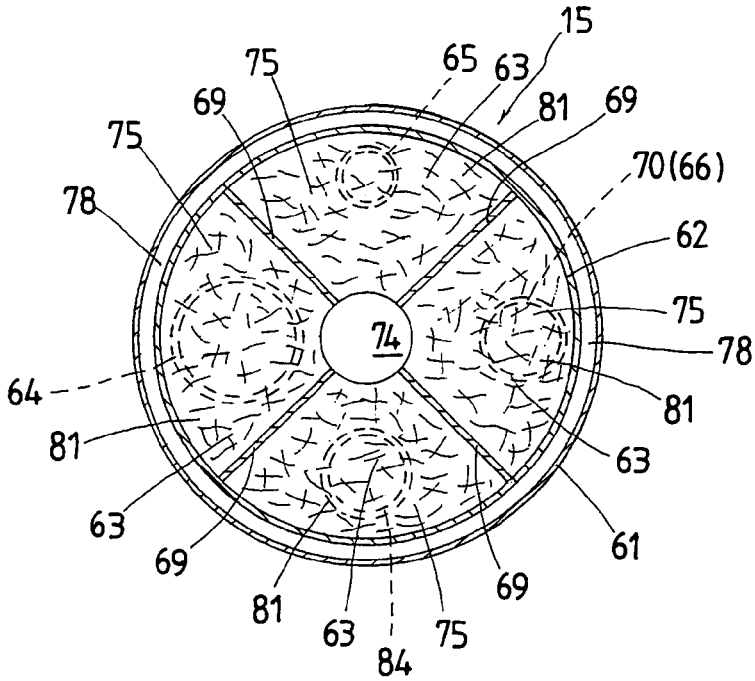
FIG. 11 is a cross-sectional view of the fuel-reforming system of FIG. 10 taken on the plane of line I—I of the same figure.

Referring next to FIGS. 10 and 11, there is shown a preferred embodiment of a fuel-reforming system 15 having incorporated with the heat exchanger of the present invention.

The fuel-reforming system 15 includes valve means to control the sequential flows of exhaust gases, steam, natural gas fuel and air: an exhaust valve 86, a steam valve 82, a natural gas valve 83 and an air valve 85. The fuel-reforming system 15 further includes a cylindrical shell 61 having a plurality of inlet ports 72 at any one of axially opposite ends thereof and a plurality of outlet ports 73 at the other end, and an circular rotary vessel 62 supported for rotation in the cylindrical shell 61 and provided therein with radial partition plates 69 (corresponding the partition wall 2 isolating the hotter and colder areas 7 and 8 from one another), which are positioned at circular intervals to form compartments 75 juxtaposed in circular direction. With the fuel-reforming system 15 constructed as stated earlier, the inlet ports 72 of the cylindrical shell 61 are communicated hermetically through sealing members 79 to, respectively, an exhaust line 64, a steam line 65, a natural gas intake line 66 and an air intake line 84. The outlet ports 73 of the cylindrical shell 61 are communicated hermetically through other sealing members 79 to, respectively, another exhaust line 64, another steam line 65, a reformed product delivery line 70 and another air intake line 84. The reformed product delivery line 70 and another air intake line 84 are merged into a single line that is communicated with a suction line 80. The natural gas intake line 6 lies in lengthwise alignment with the reformed product delivery line 70. The compartments 75 in the rotary vessel 62 have contained therein porous metallic bodies 63, one to each compartment, which have the function to alter the properties of natural gas.

The rotary vessel 62 is fixed to a turning shaft 74 that is supported in the shell 61 for rotation through bearings 76. The rotary vessel 62 is made on one axially end thereof with ingress openings allowed to come in alignment with the inlet ports 72 in the shell 61 while on the other end thereof with egress openings 68 allowed to come in alignment with the outlet ports 73 in the shell 61. Fuel line is made up of the natural gas intake line 66 connected to the associated inlet port 72 in the shell 61 and the reformed product delivery line 70 opened to the associated outlet port 73 in the shell 61, the natural gas intake line 66 and the reformed product delivery line 70 being positioned in a way lying in axial alignment with one another. The rotary vessel 62 is enclosed in the shell 61 with a vacuum space 78 being left between them, and supported for rotation through bearings 76. The rotary vessel 62 driven in circular direction by means of a motor 71 that is controlled with commands sent from a controller 60.

The porous metallic body 63 is composed of a metal including Ni, Cr, Fe, and so on. The porous metallic body 63 is coated over the overall surface thereof with alumina over which powdery zeolite is applied to absorb $CO_2$ gas from the exhaust gases. On the surface of the powdery zeolite, there is distributed a catalyst layer including Pt, Ru, Ni, Pd, $Al_2O_3$, and so on to promote the thermal reforming of the natural gas into the products of $H_2$ and CO.

Depending on commands issued from the controller 60, the motor 71 gets the rotary vessel 62 starting to rotate, coming to rest, turning in intermittent manner, and turning with variable rpm. In the reforming system 15, the exhaust gases are introduced through the exhaust line 64 into the compartment 75 in the rotary vessel 62 in which the $CO_2$ gas is absorbed by the zeolite applied on the surface of the porous metallic body 63. Subsequently, the steam produced with heat energy in the exhaust gases is led through the steam line 65 into the compartment 75 to thereby expel the exhaust gases containing oxygen therein out of the compartment 75. Natural gas is then charged through the natural gas line 66 into the compartment 75 where the reaction of natural gas with $CO_2$ absorbed by zeolite and/or activated carbon is carried out in the presence of steam to reform the natural gas into the product of CO and $H_2$.

The rotary vessel 62 is formed in, for example hollow cylinder such as circular cylinder. The rotary vessel 62 is also provided therein with radial partition plates 69 to form the compartments 75 defining rooms 81 in which are disposed porous metallic bodies 63, one to each room. In reforming process of the fuel-reforming system 15 of the present invention, as the rotary vessel 62 turns in the shell 61, the ingress openings 67 and the egress openings 68 formed in the rotary vessel 62 pass successively across the inlet and outlet ports 72 and 73 in the shell 61, respectively, which are communicated with the exhaust line 64, steam line 65, natural gas line 66 and the air intake line 73. The controller 60 is provided to apply the commands to the motor 71 to control the turning operation of the rotary vessel 62 so as to keep the rotary vessel 62 at the optimal operating condition. Thus, the motor 71 gets the rotary vessel 62 starting to rotate, coming to rest, turning in intermittent manner, and turning with variable rpm.

With the fuel-reforming system 15 constructed as stated earlier, the exhaust gases are introduced through the exhaust line 64 into the compartment 75 in the rotary vessel 62 in which the $CO_2$ gas is absorbed by the zeolite and/or activated carbon on the surface of the porous metallic body 63. Subsequently, the steam produced with heat energy in the exhaust gases is charged into the compartment 75 to thereby expel the remaining $O_2$ out of the compartment 75. There natural gas is fed into the compartment 75 where $CH_4$ in the natural gas is converted into the reformed fuel of CO and $H_2$ in the presence of $CO_2$ absorbed by zeolite and/or activated carbon, while the reaction of $CH_4$ with $H_2O$ is carried out to obtain the reformed fuel of CO and $H_2$. All the natural gas is converted into the reformed fuel of CO and $H_2$. The reformed fuel is fed, along with air introduced through the air intake line 84 into the compartment 75, through the air intake line 80 and then an air intake manifold into the engine.

Figure 12:
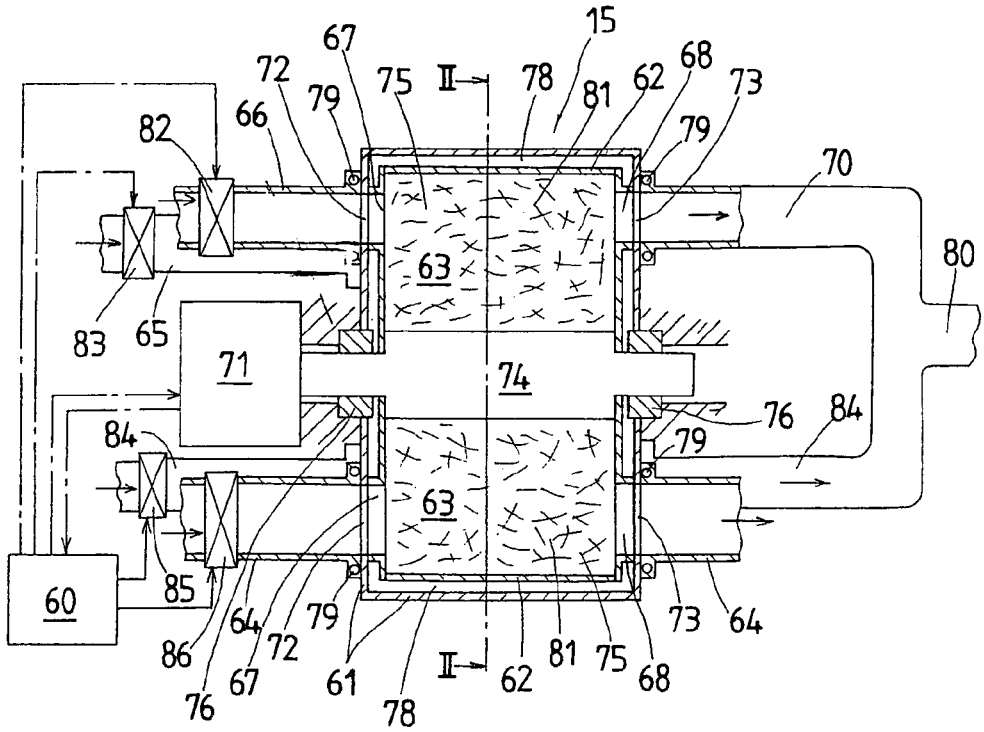
FIG. 12 is a sectional view, partially schematic, showing another embodiment of the fuel-reforming system where the heat exchangers of the present invention are incorporated therein.
Figure 13:
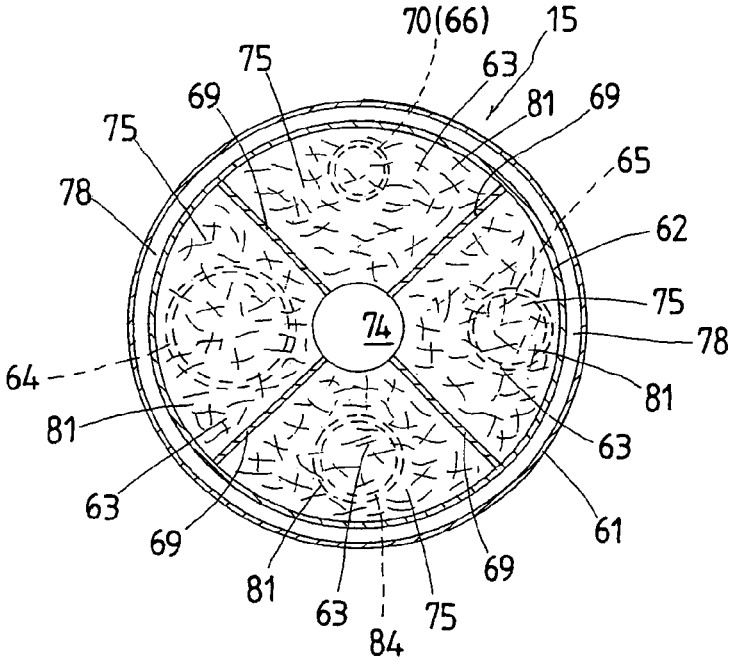
FIG. 13 is a cross-sectional view of the fuel-reforming system of FIG. 12 taken on the plane of line II—II of the same figure.

The fuel-reforming system 15, not only to the embodiment constructed as stated earlier, can be made in a facilitated construction as shown in FIGS. 12 and 13, in which the steam line 65 is closed at the outlet side thereof to get the heat energy in the steam consumed completely to reform natural gas (the reaction of the reaction of $CH_4$ with $H_2O$ is carried out to convert the natural gas into the reformed fuel of CO and $H_2$).

With the fuel-reforming system 15 of facilitated construction, the inlet ports 72 of the cylindrical shell 61 are communicated hermetically through sealing members 79 to, respectively, an exhaust line 64, a natural gas intake line 66, a steam line 65 and an air intake line 84. The outlet ports 73 of the cylindrical shell 61 are communicated hermetically through other sealing members 79 to, respectively, another exhaust line 64, a reformed product delivery line 70 and another air intake line 84. Moreover, there are provided valve means to control sequential flows of exhaust gases, steam, natural gas fuel and air (that is, the exhaust valve 86, natural gas valve 83, steam valve 82 and the air valve 85). The fuel-reforming system 15 of facilitated type further includes the motor 71 connected to the rotary vessel 62 to get the rotary vessel 62 starting to turn, coming to rest, turning in intermittent manner, and turning with variable rpm depending on the commands issued from the controller 60.

With the fuel-reforming system 15 of facilitated version constructed as stated earlier, the exhaust gases are introduced through the exhaust line 64 into the compartment 75 in the rotary vessel 62 in which the $CO_2$ gas is absorbed by the zeolite and/or activated carbon on the surface of the porous metallic body 63. Subsequently, natural gas is charged into the compartment 75 in which the reaction of $CH_4$ with $O_2$ in the exhaust gases is carried out to convert them into CO and $H_2$ while the reaction of $CO_2$ with $CH_4$ is carried out to convert them into the reformed fuel of CO and $H_2$. Then, the steam generated with heat energy stored in the exhaust gases is introduced through the steam line 65 into the compartment 75 where the remaining $CH_4$ is converted in the presence of steam ($H_2O$) into the reformed fuel of CO and $H_2$. As a result, all the natural gas is completely converted into the reformed fuel of CO and $H_2$. The reformed fuel is fed, along with air introduced through the air intake line 84 into the compartment 75, through the air intake line 80 and then an air intake manifold into the engine.

Accordingly, while the present invention has been disclosed in connection with the preferred embodiments thereof, it should be understood that other embodiments may fall within the spirit and scope of the present invention, as defined by the following claims.

What is claimed is:

1. A heat exchanger in which heat is transferred from a heat-extracting area where a first fluid is allowed to flow through the heat-extracting area to a heat-emitting area where a second fluid different in temperature from the first fluid is allowed to flow through the heat-emitting area, wherein a wall is provided to separate the areas from one another, and porous metals are provided in the areas, one to each area, the porous metals being each made on a surface thereof with a junction layer of pasty joining material kneaded with powdery metal, the porous metals being each merged together with the wall through fusion of the associated junction layer to make certain of heat transfer between the wall and the porous metals, and wherein the junction layers are buried in the porous metals in a way coming into contact with opposite sides of the wall, one to each side, and any first junction layer has a high heat-resisting property and a second junction layer has a fusing temperature more than 100° C. lower than the first junction layer, the first junction layer being made of joining material higher in fusing temperature than the second junction layer.

2. A heat exchanger constructed as recited in claim 1, wherein the porous metals are made of at least one metal selected from nickel, nickel-chrome alloy, copper and aluminum, while the wall is made of an alloy of copper and any one of nickel and nickel chrome alloy, and the powdery metal is of a heat-resisting metal superior in heat conductivity, selected from silver, nickel, copper and zinc.

3. A heat exchanger constructed as recited in claim 1, wherein the porous metals has a stem while the junction layers are bonded to the porous metals in a way the stem is either buried into the associated junction layer in a depth not less than a diameter of the stem in cross section or surrounded with the junction layer in a conical shape.

4. A heat exchanger constructed as recited in claim 1, wherein at least one metal of high heat conductivity selected from copper, aluminum and silver is coated on the surface of the porous metals by any one process of plating, dipping and vacuum evaporation.

5. A heat exchanger constructed as recited in claim 1, wherein the porous metals are each made with a groove on a surface thereof opposite to the surface bonded with the associated junction layer, the groove extending along flow of the fluid.

6. A heat exchanger constructed as recited in claim 1, wherein the porous metals are applied over the surface thereof with a ceramic coating of alumina or zirconia over which is distributed at least one catalyst selected from platinum, vanadium, rhodium, ruthenium and cerium oxide.

7. A heat exchanger constructed as recited in claim 1, wherein the porous metals are coated over the surface thereof with a plating layer of at least one material high in heat conductivity selected from copper, silver and aluminum, the plating layer varying gradually in thickness across the junction layer.

8. A heat exchanger constructed as recited in claim 7, wherein the gradual variation in thickness of the plating layer over the surface of the porous metals is done by varying a time it takes for dipping the porous metals in a plating bath.

9. A heat exchanger constructed as recited in claim 1, wherein an aluminum coating layer is made over the surfaces of the porous metals and then subjected to heat-treatment to precipitate $\alpha$-alumina structure.

10. A turbo-generator system comprising an exhaust turbine extracting energy from exhaust gases exhaled out of the heat source of an engine or a combustor, a first heat exchanger to generate high-temperature steam by a remaining energy in the exhaust gases leaving the exhaust turbine, a steam turbine extracting energy from a high-temperature steam generated in the first heat exchanger, an electric generator having a rotor shaft connected to the exhaust turbine and the steam turbine at axially opposite ends thereof, a condenser for removing heat from a steam discharged out of the steam turbine to reduce the steam to a liquid, the condenser being comprised of a porous metal installed on a tubing that allows the steam to pass through there, a pump to feed a water produced in the condenser into the first heat exchanger, a second heat exchanger installed between the pump and the first heat exchanger to convert the water forced through the pump into a steam by using a hot oil recirculating through the heat source, and the first heat exchanger in which heat is transferred from a first fluid in a heat-extracting area to a heat-emitting area where a second fluid different in temperature from the first fluid is allowed to flow through the heat-emitting area, wherein a wall is provided to separate the areas from one another, and porous metals are provided the areas, one to each area, the porous metals being each made on a surface thereof with a junction layer of pasty joining material kneaded with powdery metal, the porous metals being each merged together with the wall through fusion of the associated junction layer to make certain of heat transfer between the wall and the porous metals, and wherein the first heat-exchanger has an outer cylinder filled with a porous metal where the exhaust gases are allowed to pass through the porous metal, and an inner cylinder nested in the outer cylinder and packed inside with a porous metal where steam is allowed to flow through the porous metal, the inner cylinder being joined on an outside surface thereof with the porous metal inside the outer cylinder while on an inside surface thereof with the porous metal inside the inner cylinder through fusing metal so that the inner cylinder serves as a wall isolating the porous metals on opposite surfaces thereof from one another.

11. The turbo-generator system according to claim 10, wherein the porous metals on opposite surfaces of the wall in the first heat exchanger are joined together with the wall by fusing the junction layers of pasty joining material buried into the porous metals.

12. The turbo-generator system according to claim 10, wherein a heat insulator surrounds around a periphery of the outer cylinder, and the porous metal installed inside the outer cylinder is higher in porosity than the porous metal enclosed in the inner cylinder.

13. The turbo-generator system according to claim 10, wherein the inner cylinder is made in a way that a flow passage for the stream is made smaller in cross sectional area at an egress thereof than an ingress thereof to get a velocity of the stream faster at the egress.

14. The turbo-generator system according to claim 10, wherein a porous metal or a fin is installed or a steam line midway between the steam turbine and the condenser to cool down the steam leaving the steam turbine.

15. The turbo-generator system according to claim 10, wherein the condenser is comprised of an inside liquid chamber having a porous metal, an outside chamber for cooling gas or liquid in which a porous metal is installed, a wall separating the inside and outside chambers from one another, and a steam passage extending in the liquid chamber to deliver the steam leaving the steam turbine into the liquid chamber.

16. The turbo-generator system according to claim 10, wherein the porous metal in the liquid chamber of the condenser is made up of a plurality of multistage porous metallic sheets, which are penetrated with the steam passage at the center thereof and joined with the wall separating the liquid chamber from the gas or liquid, so that the steam is discharged out of the steam passage into the liquid chamber, where the steam passes through the porous metallic sheets with losing a remaining energy in the steam.

17. The turbo-generator system according to claim 16, wherein the porous metal in the outside chamber for cooling gas or liquid is joined together with the wall to cool down the steam discharged out of the steam turbine, so that the condenser is made in either an air-cooled system where air is forced into the outside chamber by a blower or a water-cooled system where cooling water is forced to pass through there.

18. The turbo-generator system according to claim 10, wherein the porous metal installed in the liquid chamber is made of porous material of nickel coated with at least one corrosion resisting metal including silver, copper and aluminum, while the porous metal in the outside chamber for cooling air or liquid is made of nickel-based porous metal coated with aluminum.

19. The turbo-generator system according to claim 10, wherein a rotor shaft surrounded with a permanent-magnet rotor of the generator is flanked with the steam turbine and the exhaust turbine, one to each flank.

20. The turbo-generator system according to claim 10, wherein electric power produced by the generator is supplied to either a motor to drive a compressor to force air into the heat source or a motor to spin a crankshaft of the engine through an inverter.

21. A fuel-reforming system installed in an exhaust line from an engine to convert a natural gas into a reformed fuel of $H_2$ and CO by using heat energy of exhaust gases of the engine where the reformed fuel ignites and burns, comprising:

a heat exchanger in which heat is transferred from a heat-extracting area where a fluid is allowed to flow through the heat-extracting area to a heat-emitting area where another fluid different in temperature from the fluid is allowed to flow through the heat-emitting area, wherein a wall is provided to separate the areas from one another, and porous metals are provided in the areas, one to each area, the porous metals being each made on a surface thereof with a junction layer of pasty joining material kneaded with powdery metal, the porous metals being each merged together with the wall through fusion of the associated junction layer to make certain of heat transfer between the wall and the porous metals, and where the junction layers are buried in the porous metals in a way coming into contact with opposite sides of the wall, one to each side, and any first junction layer has a high heat-resisting property and a second junction layer has a fusing temperature more than 100° C. lower than the first junction layer, the first junction layer being made of joining material higher in fusing temperature than the second junction layer.

22. The fuel-reforming system according to claim 21, further comprising: an absorption means to absorb $CO_2$ out of the exhaust gases, and catalyst means to help convert the natural gas into the reformed fuel, whereby heat energy is reclaimed from the exhaust gases.

23. The fuel-reforming system according to claim 21, further including a cylindrical shell having inlet ports and outlet ports, an circular rotary vessel supported for rotation in the cylindrical shell and provided therein with radial partition plates to form compartments juxtaposed in circular direction, porous metals accommodated in the compartments, the porous metals having an absorbing material and a catalyst thereon, and the exhaust line, steam line and natural gas line are communicated respectively to the inlet and outlet ports in the cylindrical shell.

24. The fuel-reforming system according to claim 21, including valve means to control sequential flows of exhaust gases from the exhaust line, steam from the steam line, and natural gas fuel from the natural gas line into the rotary vessel.

* * * * *